United States Patent [19]

Gunther

[11] 4,163,505

[45] Aug. 7, 1979

[54] FOLDABLE LINERS FOR FLUIDS HOLDING STORAGE TANKS

[76] Inventor: Arnold Gunther, 29 Lorelei Rd., West Orange, N.J. 07052

[21] Appl. No.: 836,034

[22] Filed: Sep. 23, 1977

[51] Int. Cl.[2] ..... B65D 89/04; B65D 89/16

[52] U.S. Cl. ..... 220/85 B; 220/216; 48/176

[58] Field of Search ..... 220/85 A, 85 B, 216, 220/218, 219, 220; 48/176, 177, 178

[56] References Cited

U.S. PATENT DOCUMENTS

| | | | |
|---|---|---|---|
| 1,597,399 | 8/1924 | Wilson | 220/216 |
| 1,631,959 | 6/1927 | Glass | 220/216 |
| 2,050,686 | 8/1936 | Wiggins | 220/85 A |
| 2,867,346 | 1/1959 | Champagnat | 220/217 |

FOREIGN PATENT DOCUMENTS

| | | | |
|---|---|---|---|
| 2458312 | 7/1976 | Fed. Rep. of Germany | 220/85 B |
| 1116444 | 5/1956 | France | 220/216 |
| 75209 | 6/1957 | Netherlands | 220/85 B |
| 9180 of 1891 | | United Kingdom | 220/220 |

*Primary Examiner*—George E. Lowrance

[57] ABSTRACT

A polyhedrical shaped liner, mounted vertically inside a cylindrical storage tank, is fixed to the inner top of the tank.

The lower portion of the liner is fixed to a rigid frame which is free to displace in the vertical direction.

Means, located on equidistant horizontal narrow strips of the liner, restrain the strips from displacing radially inwards but allow them to move in the vertical direction.

Means, that apply forces directed vertically upwards over the rigid frame and of sufficient magnitude to produce critical compressive stresses in the liner, are provided.

These critical compressive stresses induce buckling of the portions of the liner comprised between successive narrow strips and folding of the liner in-situ is achieved.

5 Claims, 2 Drawing Figures

FOLDABLE LINERS FOR FLUIDS HOLDING STORAGE TANKS

BACKGROUND OF THE INVENTION AND RELATED APPLICATIONS

Related applications have been filed under Ser. No. 779,137 filed Mar. 18, 1977 and Ser. No. 795,622 filed May 10, 1977.

The evaporation losses emanating from the liquids stored in the tanks, and due mainly to filling, emptying and "breathing" of these tanks, are substantially suppressed by the devices referred to in the above related applications.

These devices utilize collapsible containers, made out of suitable polymeric materials, such as polypropylene, polyurethane, fluoropolymers, etc. The side walls of these collapsible containers, built out of single or multilayer sheets or films of the thermoplastics just mentioned, are corrugated or folded to facilitate the collapsing or expanding of same.

The corrugations or folds are built into the container's wall prior to their installation in the storage tank they are to serve.

The construction of the corrugated surface, starting from a planar surface, requires special manufacturing methods.

One of such methods is thermoforming, which consists in the shaping of a preheated thermoplastic flat sheet in molds, shaped with the desired corrugations, by the application of pressure.

By this means, corrugated panels having the desired curvature to fit the circumferential tank's shell are obtained.

The size of a corrugated panel is limited to the largest size mold that is practical to fabricate and operate.

When the storage tanks sizes are considered, with sizes ranging from 25 feet to 200 feet in diameter and heights between 20 and 80 feet, it may be realized that many such corrugated panels are required for a tank.

The panels are subsequently joined together to form a curtain by welding their edges to a maximum size dictated by shipping, handling and mounting inside the tank considerations.

It has to be noted, that whereas a flat sheet is extremely flexible, foldable in any direction, and can easily be rolled into a relatively small diameter cylinder, the corrugated panels have built-in considerable stiffness which precludes them to be rolled and folded in any direction without creating undue stresses, except in the axial direction for the contraction or expansion of the corrugations.

It may now be realized that this fact imposes restrictions on the largest size for corrugated curtains that can be handled in practice.

This further requires that the individual curtains be joined together inside the tank, by welding their edges together in order to build the entire walls for the collapsible containers.

Other manufacturing method consists in the extrusion of corrugated rectilinear strips, followed by bending the reheated strips into the required curvature. These bent corrugated strips are joined into curtains by welding their edges together.

The related Gunther applications before mentioned are intended for use in liquid holding storage tanks.

By utilizing their same broad principles they are also applicable for gas holding storage tanks operating at substantially atmospheric pressure, and more specifically for the dry-seal type gasholders.

The space, which is occupied by the liquid and its vapors in the related applications, will be occupied by the gas to be stored, when these inventions are intended to be used as gasholding devices.

Dry-seal gasholders of the prior art consist of a tank with a vertically moving piston connected to the side wall by a series of parallel sealing rings of a special flexible synthetic rubber impregnated fabric chemically inert to the gas being stored. Since the piston freely floats on the gas, means of guiding and leveling this piston must be used.

Maintenance and leakage through the fabric seals, which wear due to the rubbing against the metalic surfaces they engage, are drawbacks that are overcome by the use of the present invention.

SUMMARY OF THE INVENTION

The present invention deals with foldable liners used in conjunction with liquid or gas holding tanks to provide a seal between the fluid held in the tanks and the surrounding atmospheric air.

In the case of liquid holding tanks these foldable liners provide an effective barrier against leakage of the vapors of the stored liquids into the ambient air, as is fully disclosed in my copending applications, Ser. Nos. 779,137 and 795,622.

When applied to gas holding tanks, the gas being at essentially atmospheric pressure, these liners provide a variable holding space for the gas, and the liners in conjunction with the tank constitute a gasholder operating at atmospheric pressure.

The fabrication of foldable or collapsible liners, generally affecting the shape of a cylindrical bellows or accordion, which are fitted and supported by proper means to the tanks, required theretofore preforming of the corrugations into the liners, prior to their installation in the tanks.

The building of the corrugations into the liners requires, in turn, special manufacturing procedures, such as thermoforming of flat thermoplastic sheets, which consists of shaping a preheated flat sheet in molds, shaped with the desired corrugations, by the application of pressure.

Another procedure, for instance, consists in the extrusion of straight strips that have their cross sections corrugated, followed by bending the reheated strips into a cylindrical shape.

One of the main objectives of this invention is to provide foldable liners that will avoid the necessity for preforming the folds or corrugations prior to the installation in the tank.

Another objective is to simplify the installation of the collapsible liners in the tanks and thereby further decrease the total installed cost for them.

The foldable liners with which this invention is concerned, when in their fully stretched position, affect the shape of a right prism's lateral surface, with the prism's vertical axis coinciding with the tank's vertical axis. When fully stretched or unfolded the vertical faces of the prism are substantially planer or flat, constituting a regular (equal surface faces) polyhedron.

A cross section perpendicular to the vertical axis produces a regular polygon inscribed in a circle of a diameter slightly smaller than the tank shell's inside diameter.

The uppermost portion of the polyhedrical liner is fastened and sealed to the corresponding inner uppermost portion of the tank's shell. Convenient means, such as a steel angle iron welded to the shell, and to which the liner is fastened and sealed by gasketing or other means, provide the necessary spacing between the shell and the liner.

The lowest portion of the polyhedral liner is fastened and sealed to a substantially rigid frame, free to displace in the vertical direction, which in the case of liquid holding tanks would constitute the floatation ring.

Cables or rods are vertically located facing the vertical edges of the prismatical surface of the liner. These cables or rods are located in the space between the liner and the tank shell. They are supported at their extreme portions by suitable means with their extremities located at the top and bottom portions of the shell.

Tensional means, such as turnbuckles are located in the lower portions of the rods or cables.

The edges of the polyhedron are kept from displacing radially inwards by strips that are welded at these edges at one of their ends and slide over the cables on the other end.

Metallic grommets are provided in the sliding end of the strips, which are usually made of the same material as the liners, to spread the tensional stresses evenly through the strips and to provide lasting rubbing surfaces.

A series of parallel polygons are obtained by parallel horizontal cross sections. The distance between two consecutive cross sections is equal approximately to twice the amplitude of the desired corrugations or folds.

The vertices of the polygons are allowed, by convenient means, (examples of which are given in the detailed description of this invention), to move in the vertical direction but are not allowed to move radially inwards.

Compressive forces in the vertical direction applied to the liner, will cause it to buckle. These compressive forces are supplied by convenient means such as the buoyancy forces on the floatation ring, for example.

The buckling will take place between the successive parallel polygons above mentioned, that due to the restrains imposed on them, will remain in the vertical plans that contain the acting compressive forces.

The buckling will cause folding in the areas of the liner comprised between two consecutive parallel polygons, and the folding will be in the radially inwards direction.

Buckling in the radially outwards direction would require stretching of the liner, or hoop stresses, which are not available with the presently applied compressive forces.

The buckling in the radially inwards direction tends to decrease the surface of the liner, and consequently the liner folds to comply with this requirement.

The continuous application of the above mentioned compressive forces will cause a gradual shortening of the distances between the consecutively restrained polygons, thereby increasing the size of the fold's amplitude.

Finally these distances will virtually vanish and the fold's amplitude will be about one half of the starting distance between successively restrained polygons.

The liner is now completely folded or collapsed. Removal of the compressive forces and application of tensile forces will cause the liner to expand or unfold.

In practice this is accomplished by the lowering of the liquid level in the tank. Part of the weight of the floatation ring and the liner, will provide the required pull. Other examples will become apparent in the detailed description of this invention.

The folds' amplitude is a small fraction of the tank's radius. The range in practice is about 1 (one) to 6 (six) inches.

For tanks' diameters ranging from 20 feet to 200 feet, the ratio of the fold's amplitude to the tank's radius is 1/120 to 6/1200 or about 0.01 to 0.005.

That means that when the liner is fully folded or totally collapsed the perimeter of the polygon defined by the innermost portions of a continuous fold is 99% to 99.5% of the perimeter of the fully stretched or unfolded liner.

Consequently, compressive stresses, in the horizontal direction, develop as the folds increase in amplitude and will cause buckling or interpenetration of successive rectilinear portions of the continuous polygonal fold.

Depending on the ratio $r=E/(l/k_z)^2$ of the rectilinear portions of the continuous fold, where B is the elastic modulus of the material, l is the length of the rectilinear fold, $k_z$ is the radius of gyration of the fold cross section with respect to an axis z located over a radial axis in the plane of symmetry for the fold, these rectilinear portions will buckle into a wavy shape for relatively small r ratios or they will penetrate each other at the regions near the vertices of the polygons, for relatively large r ratios. The ratio $l/k_z$ is the slenderness ratio for the fold.

Liners fabricated out of materials such as polyurethane sheets, which have a very low elastic modulus E (around 500 to 1000 psi), will fold with the wavy appearance mentioned.

On the other hand, high density polyethylene, polypropylene, certain fluoropolymers, etc., have relatively large modulus (100,000 to 200,000 psi) and the type of fold will depend on the slenderness ratio.

For relatively short rectilinear folds they will interpenetrate, and for long folds they will wave.

As an illustration, the compressive stress required for folding liners built out of materials possessing a large elastic modulus are of the order of 10 to 30 psi approximately.

For a liner 10 mils (0.01 inch) thick it translates into 1.2 lb/linear foot to 3.6 lb/lineal foot.

A variety of polymeric materials, single layered or composites of two or more layers, are readily available in film or sheet form for the liner's materials of construction.

By proper choice of the polymeric materials, practically the majority of the industrially stored commodities can be in contact with the liners with virtually no solvation effects and negligible vapor permeation. Examples of single layered materials are films or sheets of polyethylene, polypropylene, polyurethane, and fluoropolymers such as "Halar." "Halar" is a trade mark for a fluorocarbon thermoplastic, manufactured by the Allied Chemical Corp.

Examples of composites are epoxy coated polyethylene, epoxy coated polypropylene, epoxy coated polyurethane, where the epoxy coating is only a few mils or less thick.

Laminates of "Halar," epoxide and polypropylene is an example of a three layered composite film or sheet, the epoxide serving as the bonding agent between the "Halar" and the polypropylene. Acrylic resins are also used as bonding agents.

"Halar" is virtually inert to a great many of the industrially stored liquids, and is applied in thicknesses of the order of a few mils.

The bonding epoxide or acrylate is a fraction of a mil thick and the substrate, which is generally the least costly material, constitutes the bulk of the liner's thickness, which is of the order of 10 to 30 mils.

BRIEF DESCRIPTION OF THE DRAWINGS

Reference is now made to the drawings.

DETAILED DESCRIPTION

Figure 1:
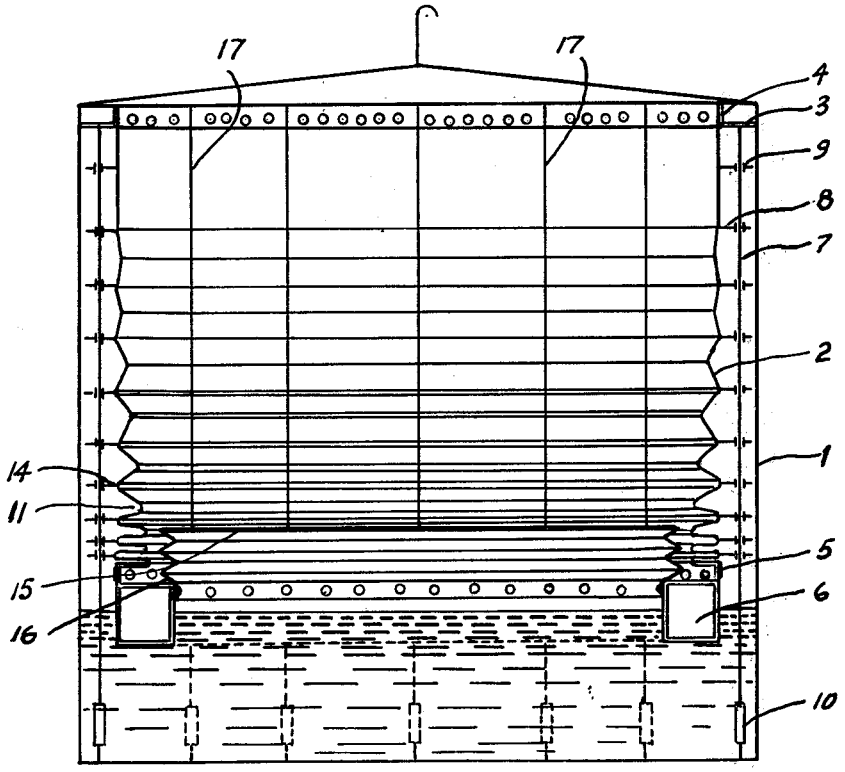
FIG. 1 is a semidiagrammatic vertical section of a typical embodiment for liquid storage tanks.

In FIG. 1, the storage tank is indicated with number 1. The liner 2, shown partially folded, is bolted to the frame 3 which is welded to the tank's shell. A continuous strip 4 of a resilient material, such as asbestos, silicone rubber, etc., is interposed between the top liner 2 and frame 3 to seal against leakage through the juncture.

The frame 3 offers a prismatical surface for the attachment of the liner 2.

The lower portion of the liner 2 is similarly bolted and gasketed to a prismatical ring 5, which is part of the floatation ring 6.

The edges of the prismatical surfaces of frame 3 and ring 5 lie substantially on the same vertical lines.

These vertical lines define the edges of the liner when it is in its fully stretched position, or completely unfolded.

Cables or rods 7, located between the tank's shell and the liner 2, lie vertically facing the edges of the liner.

Strips 8, fastened to the liner by proper means (in the preferred construction, the strips, of an identical material as the liner, are welded to it) ride over the cables 7.

Metallic grommets 9 are inserted into the strips to decrease friction, and especially to provide a lasting surface against wear and the stresses generated by the folding of the liner.

Turnbuckles 10 provide the initial tension required in the cables or rods.

The strips 8 are placed in the regions containing the vertices of the polygons defined by the intersections of equidistant horizontal planes with the fully stretched liner.

The vertical distances between the horizontal places is approximately twice the desired fold's amplitude.

Th fold's amplitude is here defined by the distance between a crest 11 and a valley 14 when fully folded.

Numeral 15 indicates the collapsible floor, shown here with corrugated side walls 16 which allow for its required vertical displacements.

The corrugated side walls 16 can be preformed prior to their installation in the tank, or, they can be folded in-situ by utilizing the principles of this invention.

The liners 2 are flat or unfolded when installed in the tank they are to serve.

In order to fold them in-situ, all is required is the application of compressive stresses along the liner's walls acting in the vertical direction.

For the liner 2, these compressive stresses are provided by the buoyancy forces of the floating ring 6.

Filling of the tank with the liquid to be stored will cause the floating ring to raise following the liquid level.

As soon as the forces applied by the floating ring reach the critical load for the liner's portions comprised between successive strips layers, they will buckle inwardly. Gradual raising of the liquid level causes the lower folds to increase their amplitude.

When the lowest folds reach a substantial amplitude, they start pushing upwards the contiguous ones. It may be seen that the generation of the folds is similar to a wave transmission through the height of the liner. The main cause for this behavior are the frictional resistances caused by the cables on the strips which give birth to stresses opposing the acting compressive stresses. Consequently, the resultant stresses available for buckling and folding decreases with height.

As explained before in the summary of this invention, the successive rectilinear portion of the same horizontal fold intersect at the edges of the liner and they penetrate each other, in a manner similar to the folds found in the expandable cardboard containers used for filing documents, correspondence and the like.

Numeral 17 indicates schematically the intersection curves along the edges of the liner.

Figure 2:
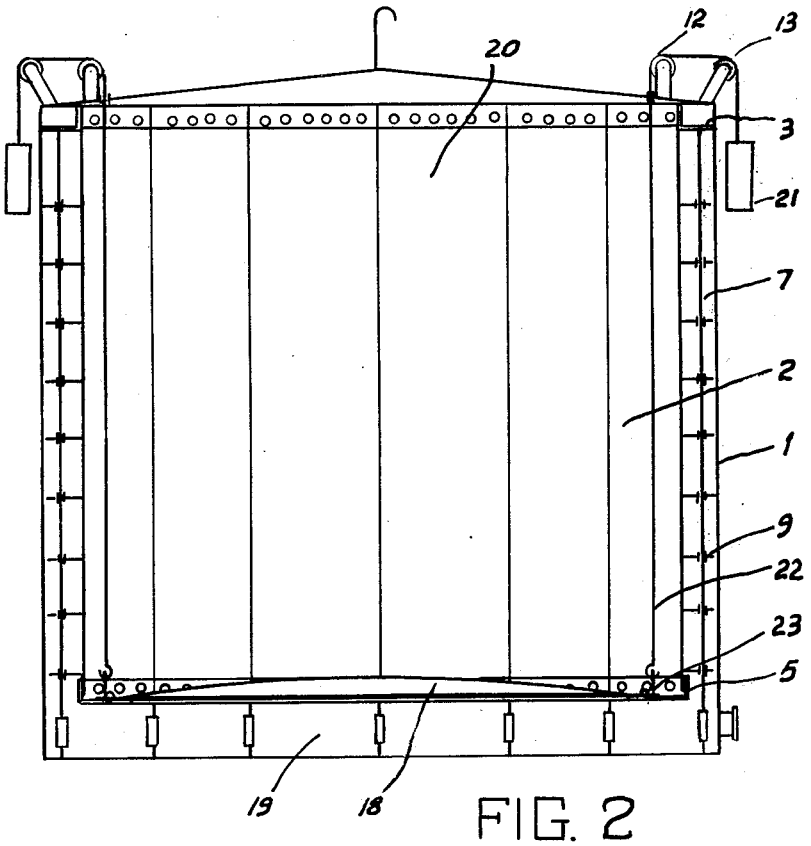
FIG. 2 is a semidiagrammatic vertical section of a typical embodiment for gas storage tanks.

Referring now to FIG. 2, which represents an example of the application of this invention to a gasholder, numeral 1 indicates a tank, numeral 2 indicates a foldable liner shown here in its fully stretched or unfolded position.

The liner 2 is attached and properly gasketed to the frame 3 which is welded to the tank.

The lower portion of the liner is attached and gasketed to the frame 5, which is free to displace in the vertical direction.

The floor 18, generally built with the same material as the liner, although it can be of any convenient material, such as thin gage steel, aluminum, etc., is fastened and gasketed to the frame 5.

The strips 8 are attached to the edges of the liner 2, at one end, and ride over the cables 7, at the other end.

The gas stored in the tank fills the space 19 underneath the floor 18 and the annulus comprised between the liner 2 and the shell of tank 1. Atmospheric air fills the space indicated by numeral 20.

The compressive stresses required for the folding of the liner in-situ, which when installed in the tank is completely unfolded or flat and takes the shape of the lateral surface of a right prism, may be obtained by creating a pressure differential across spaces 19 and 20.

This pressure differential, which is obtained by pressurizing the gas contained in space 19 has to be sufficient to overcome the folding stresses and the weight of the frame 5 and floor 18.

For gasholders, which have diameters ranging from 50 feet to about 200 feet, the pressure required is of the order of a fraction of an inch of water column.

With liners and floor built out of polymeric materials possessing a relatively high elastic modulus, the stresses imposed by this pressure are well below the safe working stress.

When, because of the nature of the gas stored, polymeric materials which are unaffected by the gas but possessing low elastic modulus have to be used, recourse is made to the counterweights 21.

These counterweights, acting through cables 22, that ride on pulleys 12 and 13, provide the necessary compressive forces before mentioned.

The cables 22 are hooked to the frame 5 at points 23 evenly distributed. No pressure differential is now required, and there are no undue stresses on the liner and floor.

I claim:

1. A device for folding vertical liners with a polyhedral shape comprising, in combination, a. a liquid holding storage tank with a frame welded to the inner top portion of said tank's shell, the inner face of said frame being a vertical surface prismatically shaped and substantially concentrical with the tank's shell, the distance between said inner face and said shell being substantially a small fraction of the said shell's diameter, b. a freely moving, substantially rigid frame, located inside the tank and free to displace in the vertical direction, the inner surface of this frame having a vertical prismatical shape substantially identical to the said welded frame, c. a vertical liner, concentrically located to the said tank's shell, its top portion attached to the inner face of said welded frame, its bottom portion attached to the inner face of the said freely moving frame, the vertical liner taking the shape of a polyhedrical surface with a number of faces equal to the number of faces of each of said frames, d. a plurality of vertical cables having their top portions attached to the said welded frame and their bottom portions attached to said tank's floor, the cables being located between the said vertical liner and the said tank's shell and facing said liner's vertical edges, the number of cables being equal to the number of said vertical edges, e. a plurality of strips with one of their ends attached to the edges of said vertical liner, their other end being traversed by said vertical cables and free to slide over said cables, said strips being located in a plurality of horizontal plans, said strips cooperating with said freely moving frame to fold said vertical liner for an upward displacement of said frame and to unfold said liner for a downward displacement of said frame, f. means to induce vertical motions in the said freely moving rigid frame.

2. A device for folding vertical liners with a polydedral shape, as claimed in claim 1, in which the said freely moving rigid frame is part of a rigid structure that floats in the liquid contained in the said storage tank, and the said means to induce vertical motions are provided by the buoyancy of said rigid structure.

3. A device for folding vertical liners with a polyhedral shape, as claimed in claim 1, in which the means to induce vertical motions in the said freely moving rigid frame are provided by counterweights that exert pull forces on said frame.

4. A gasholder for gases at atmospheric pressure comprising, in combination, a. a cylindrical tank with a frame welded to the inner top portion of said tank's shell, the inner face of said frame being a vertical surface prismatically shaped and substantially concentrical with the tank's shell, the distance between said inner face and said shell being substantially a small fraction of the said shell's diameter, b. a freely moving, substantially rigid frame, located inside the tank and free to displace in the vertical direction, the inner surface of this frame having a vertical prismatical shape substantially identical to the said welded frame, c. a vertical liner, concentrically located to the said tank's shell, its top portion attached to the inner face of said welded frame, its bottom portion attached to the inner face of the said freely moving frame, the vertical liner taking the shape of a polyhedrical surface with a number of faces equal to the number of faces of each of said frames, d. a plurality of vertical cables having their top portions attached to the said welded frame and their bottom portions attached to said tank's floor, the cables being located between the said vertical liner and the said tank's shell and facing said liner's vertical edges, the number of cables being equal to the number of said vertical edges, e. a plurality of strips with one of their ends attached to the edges of said vertical liner, their other end being traversed by said vertical cables and free to slide over said cables, said strips being located in a plurality of horizontal plans, said strips cooperating with said freely moving frame to fold said vertical liner for an upward displacement of said frame and to unfold said liner for a downward displacement of said frame, f. an horizontal membrane fixed to the said freely moving rigid frame.

5. A gasholder for gases at atmospheric pressure comprising, in combination, a. a cylindrical tank with a frame welded to the inner top portion of said tank's shell, the inner face of said frame being a vertical surface prismatically shaped and substantially concentrical with the tank's shell, the distance between said inner face and said shell being substantially a small fraction of the said shell's diameter, b. a freely moving, substantially rigid frame, located inside the tank and free to displace in the vertical direction, the inner surface of this frame having a vertical prismatical shape substantially identical to the said welded frame, c. a vertical liner, concentrically located to the said tank's shell, its top portion attached to the inner face of said welded frame, its bottom portion attached to the inner face of the said freely moving frame, the vertical liner taking the shape of a polyhedrical surface with a number of faces equal to the number of faces of each of said frames, d. a plurality of vertical cables having their top portions attached to the said welded frame and their bottom portions attached to said tank's floor, the cables being located between the said vertical liner and the said tank's shell and facing said liner's vertical edges, the number of cables being equal to the number of said vertical edges, e. a plurality of strips with one of their ends attached to the edges of said vertical liner, their other end being traversed by said vertical cables and free to slide over said cables, said strips being located in a plurality of horizontal plans, said strips cooperating with said freely moving frame to fold said vertical liner for an upward displacement of said frame and to unfold said liner for a downward displacement of said frame, f. an horizontal membrane fixed to the said freely moving rigid frame, g. counterweighing means to exert pull forces on said freely moving rigid frame.

* * * * *